US009396647B2

(12) United States Patent
Haines

(10) Patent No.: US 9,396,647 B2
(45) Date of Patent: Jul. 19, 2016

(54) SYSTEM OF DETECTING INCARCERATION OF AN INDIVIDUAL AND NOTIFYING INTERESTED PARTIES, AND RELATED METHODS

(71) Applicant: Andrew Marr Haines, Oceanside, CA (US)

(72) Inventor: Andrew Marr Haines, Oceanside, CA (US)

( * ) Notice: Subject to any disclaimer, the term of this patent is extended or adjusted under 35 U.S.C. 154(b) by 0 days.

(21) Appl. No.: 14/542,477

(22) Filed: Nov. 14, 2014

(65) Prior Publication Data

US 2015/0130616 A1 May 14, 2015

Related U.S. Application Data

(60) Provisional application No. 61/904,401, filed on Nov. 14, 2013.

(51) Int. Cl.

| | |
|---|---|
| ***G08B 23/00*** | (2006.01) |
| ***G08B 27/00*** | (2006.01) |
| ***G08B 21/02*** | (2006.01) |

(52) U.S. Cl.

CPC ..... *G08B 27/00* (2013.01); *G08B 21/02* (2013.01)

(58) Field of Classification Search

CPC .... H04M 3/38; G06F 19/322; G06F 19/3425; G06Q 10/10; G06Q 50/22; G08B 21/02; G08B 27/00; H04N 7/14; H04N 7/141

USPC ..... 340/573.1, 573.4, 540, 531, 539.1, 6.1, 340/8.1

See application file for complete search history.

(56) References Cited

U.S. PATENT DOCUMENTS

| | | | | |
|---|---|---|---|---|
| 7,529,357 | B1 * | 5/2009 | Rae | H04M 3/38 370/261 |
| 8,554,170 | B2 * | 10/2013 | Franz | H04W 4/14 379/41 |
| 2009/0209202 | A1 * | 8/2009 | Martini | H04W 12/02 455/41.2 |
| 2011/0258118 | A1 * | 10/2011 | Ciurea | G06Q 20/40 705/44 |
| 2014/0269482 | A1 * | 9/2014 | Pandey | H04W 4/06 370/312 |
| 2014/0279789 | A1 * | 9/2014 | Torgersrud | G06Q 30/02 706/46 |
| 2015/0081574 | A1 * | 3/2015 | Selby | G06F 3/0481 705/311 |

* cited by examiner

*Primary Examiner* — Daniel Previl

(74) *Attorney, Agent, or Firm* — Buche & Associates, P.C.; John K. Buche; Bryce A. Johnson

(57) ABSTRACT

Generally, disclosed is an automatic messaging system for providing a text or other message to a third party that notifies said party when a person has been arrested and is being held in police custody. Also disclosed may be a system employing software that will alert a family member whenever a loved one has been incarcerated. In one embodiment, a user can sign up for a service so that the user's name and information will be entered into an information database and used to monitor hundreds of public police arrest records from various localities wherein, if the user is arrested and incarcerated, then the service will automatically send a notification to a designated contact, such as the user's attorney, family member, or friend.

13 Claims, 3 Drawing Sheets

SYSTEM OF DETECTING INCARCERATION OF AN INDIVIDUAL AND NOTIFYING INTERESTED PARTIES, AND RELATED METHODS

CROSS-REFERENCE TO RELATED APPLICATIONS

This application claims the benefit and priority of U.S. Prov. Pat. App. No. 61/904,401 filed on Nov. 14, 2013 entitled "System of detecting incarceration of an individual and notifying interested parties, and related methods." This document is incorporated by reference in its entirety.

STATEMENT REGARDING FEDERALLY SPONSORED RESEARCH OR DEVELOPMENT

Not applicable.

BACKGROUND OF INVENTION

1. Field of the Invention

The subject matter of this specification is in the field of systems for detecting incarcerations and notifying interested parties of the same.

2. Background of the Invention

Incarcerations and other forms of imprisonment of an individual are known to occur under authority of a state or federal government as a form of punishment. Frequently, incarcerations are not planned by the arrested individual. Unplanned incarcerations can be problematic because, usually, communication by the arrested individual is restricted so that loved ones or employers may not be immediately made aware of the incarcerated person being in custody. For instance, some jurisdictions afford the arrested individual the right to make a telephone call, but in some states, the arrested individual may only make a telephone call to contact a lawyer or arrange for bail. Additionally, jail conditions can vary drastically throughout the country and the world, so it may be difficult, if not impossible, for an incarcerated person to communicate to an attorney, friend, or family member that they have been incarcerated.

Moreover, an individual may not have a list of contacts with them or know any third party contact information when they are arrested and therefore, will be unable to contact anyone when given the opportunity to use a telephone. Thus, a list of designated contacts will be helpful in situations where an arrested individual is without any third party contact information.

Currently there are several systems that send an automatic message to inform people of emergencies, amber alerts, or other calamities. For instance: WO 2004114694 A1 (2004) by Kennedy teaches a notification system that sends a text message to subscribers when there is an Amber Alert; WO 2013009620 A1 (2012) by Ramos teaches a system that will send emails or text messages in the event of a weather emergency, natural disaster, terrorist event, or other disaster; EP09322532B1 (2003) to Karlsson teaches a system that sends a text message in the event of a damage to a parked automobile; U.S. Pat. No. 8,554,170 B2 (2013) to Franz teaches a system that will send an alert to a cell phone user's designated emergency contact if 911 is dialed. However, no system is known to currently exist that allows a user to input a set of contacts and sends a notification to a contact when a person is arrested or otherwise incarcerated.

SUMMARY OF THE INVENTION

In view of the foregoing, it is an object of the present invention to provide a person who has been arrested and incarcerated with an automatic messaging system to send a message or notification to a designated contact to notify that party that an individual has been arrested and is being held in police custody.

It is another objective of the present invention to provide family members a system that will alert them when a loved one has been incarcerated. In one embodiment, a user can sign up for a service. After the user has signed up, the user can enter another individual's information that is to be searched, and that information will be entered into an information database. Suitably, the processing server will continuously monitor hundreds of public police arrest records from various localities.

Still another object of the present invention is to help a family member of a person who has had a history of addiction or mental illness and may have cognitive difficulties contacting an attorney or family member in the event of an arrest. In this embodiment, the disclosed system will alert a family member that their loved one has been arrested.

In a preferred embodiment, if a user who is signed up for the service is arrested and incarcerated, then the service will automatically send a message to a third party, such as the user's attorney, family member, or friend. Preferably, the notified party may then post bail or otherwise assist in the release of the incarcerated user.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting in their scope, for the disclosed assemblies may admit to other equally effective embodiments that will be appreciated by those reasonably skilled in the relevant arts. Also, figures are not necessarily made to scale.

DETAILED DESCRIPTION OF THE INVENTION

Generally, disclosed is an automatic messaging system for providing notifications to designated contacts when a person has been arrested and is being held in police custody. The automatic messaging system searches public arrest databases and when a match between the incarcerated individual's information and an arrested individual's information in a database is found, the system will send a text message, e-mail, or other form of a message to the designated contact or contacts. The system disclosed offers an efficient way to alert a family member, friend, co-worker, or employee whenever an individual has been incarcerated.

Figure 1:
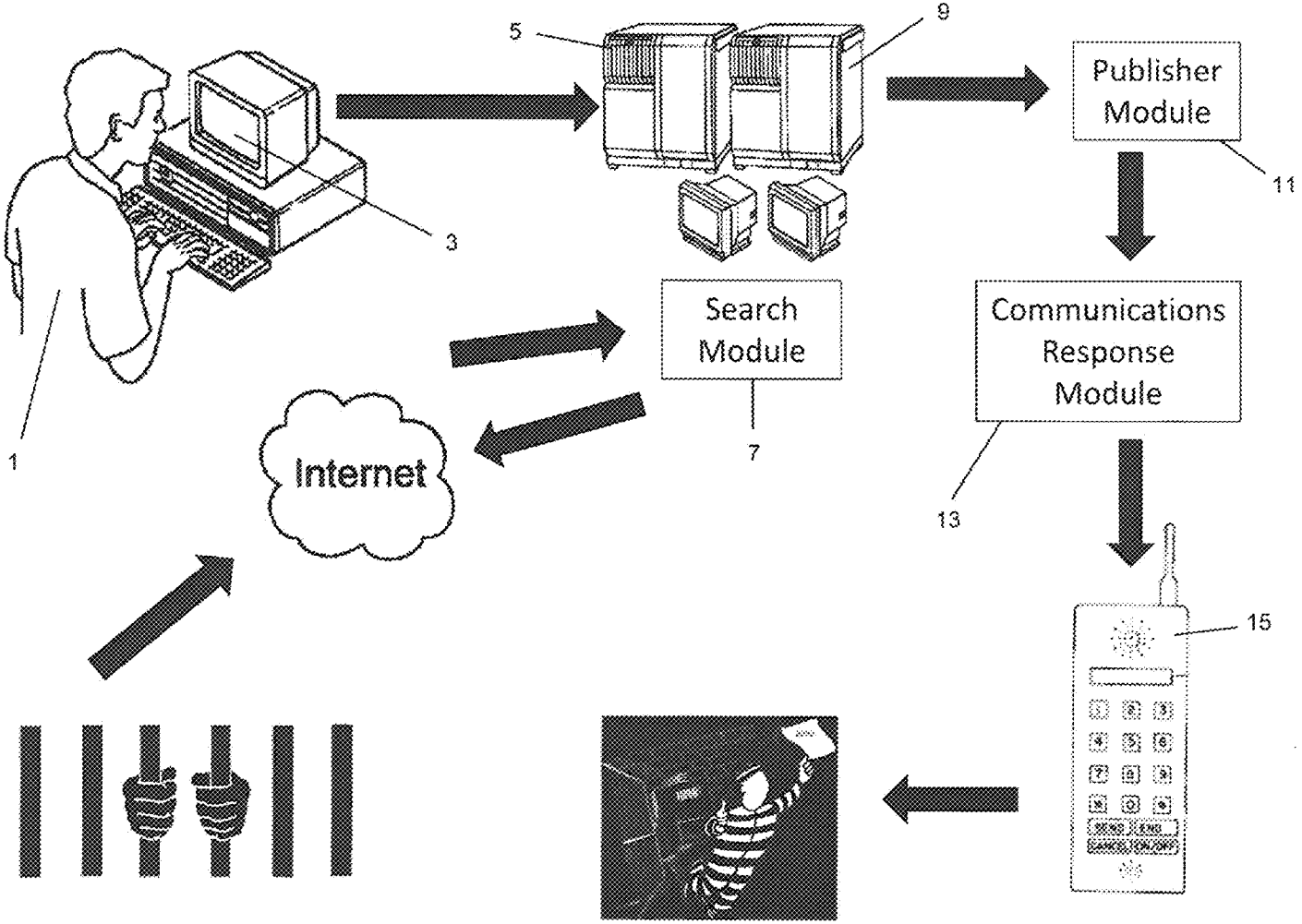
FIG. 1 is a flow chart of one embodiment of the system of the present invention.

FIG. 1 is a schematic illustration of the system of the present invention. As shown, the system, employing software, may be used to alert a designated contact 15 in the event of an arrest or incarceration. Referring to FIG. 1, in one embodiment, through the use of a processing server, a user 1, through an internet network or through a tangible document, may create an account and subscribe for a service. A user interface module 3 will present a user 1 with a plurality of data fields, wherein the user 1 enters their name, date of birth, place of birth, height, weight, and other information that will be known to one of skill in the art. The user's 1 information is then stored in the information database 5. A user 1 may sign up for the service using his or her computer, mobile phone, tablet, or other message receiving device. A search module 7 is configured to search public police arrest records from various databases for the user's 1 inputted data. A processing system 9 then determines if there is a match between a user's 1 information and a record in an arrest database. If a match is found, then the publisher module 11 will generate a notification and a communication response module 13 will automatically send a text message, e-mail, or other message service to a communication device of a designated contact 15, such as the user's 1 attorney, family member, or friend. The processing server, search module 7, processing system 9, publisher module 11, and communication response module 13 may employ the use of software known to one of skill in the art.

Figure 2:
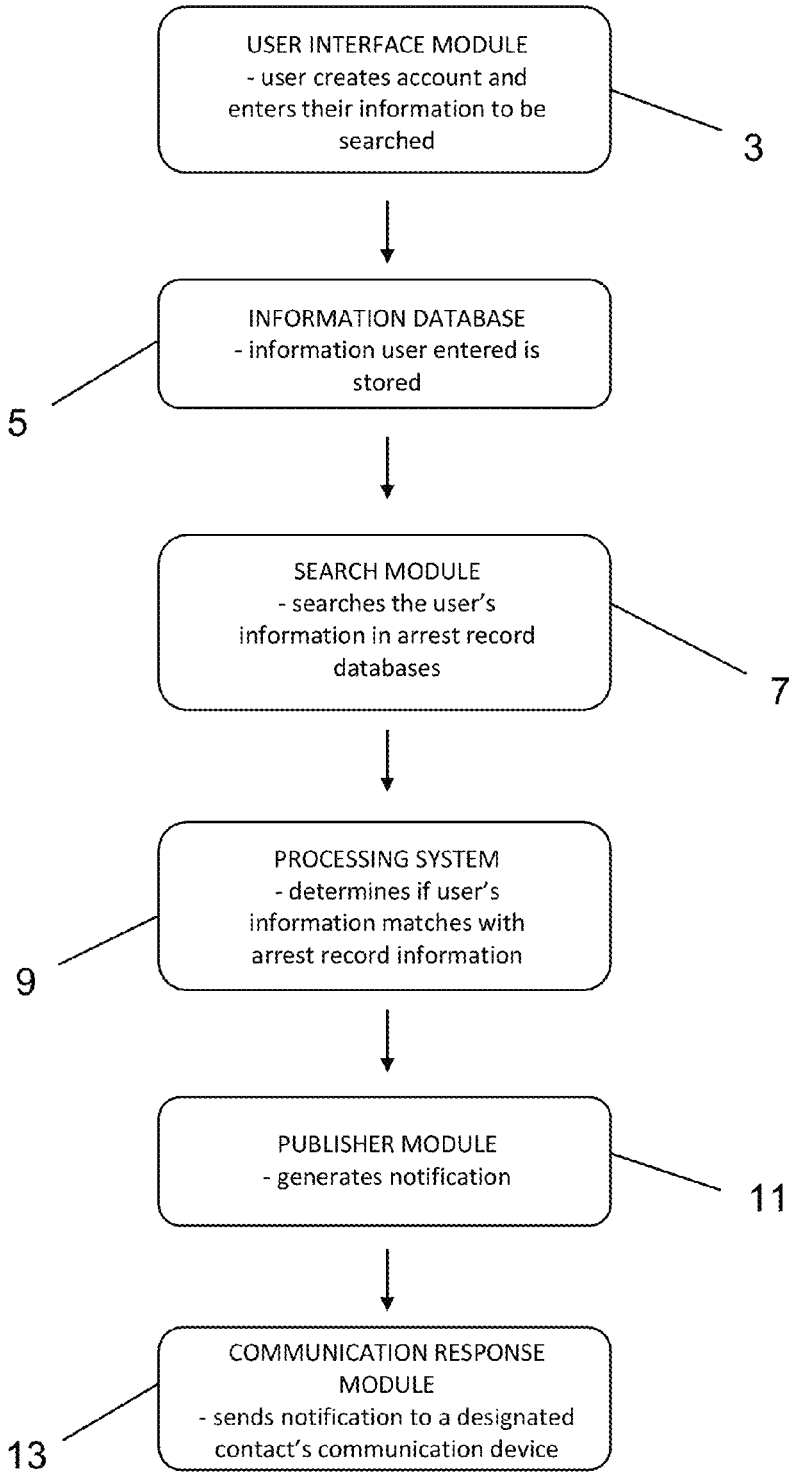
FIG. 2 is a flow chart of an alternative embodiment of the system of the present invention.

Referring to FIG. 2, in one embodiment, if the user 1 is the one who would like to be searched, if ever incarcerated, and wants their contacts to be notified, then the user 1 may enter their own personal information into the user interface module's 3 plurality of data fields, such as a full name, place of birth, date of birth, height, weight, or address and the contact numbers, e-mails, whichever is preferred, of any third party contacts in the respective data fields. The information the user 1 entered will be collected by a processing server and stored in an information database 5. A search module 7 will systematically and programmatically search the internet for public arrest records for the information the user 1 entered. Alternatively, the processing server 5 may request arrest records under the Freedom of Information Act. If the user 1 is ever arrested and the information of the arrest is made public, then the processing system 9 will cross reference and match the user's 1 inputted information from the information database 5 with the search module's 7 search results. When the information of an arrested individual matches the information of the user 1, the publisher module 11 will generate a notification and the communication response module 13 will automatically send the notification to at least one of the user's 1 designated contact's 15 mobile telephone, computer or other messaging device, via text message, e-mail, or other message service. The alert or notification may include information relating to the arrest, such as the date, time, and location where the individual is held. The designated contact 15 who receives the notification will be notified of the user's 1 arrest and may be able to take any actions needed to assist the incarcerated individual, such as providing bail or legal advice.

Figure 3:
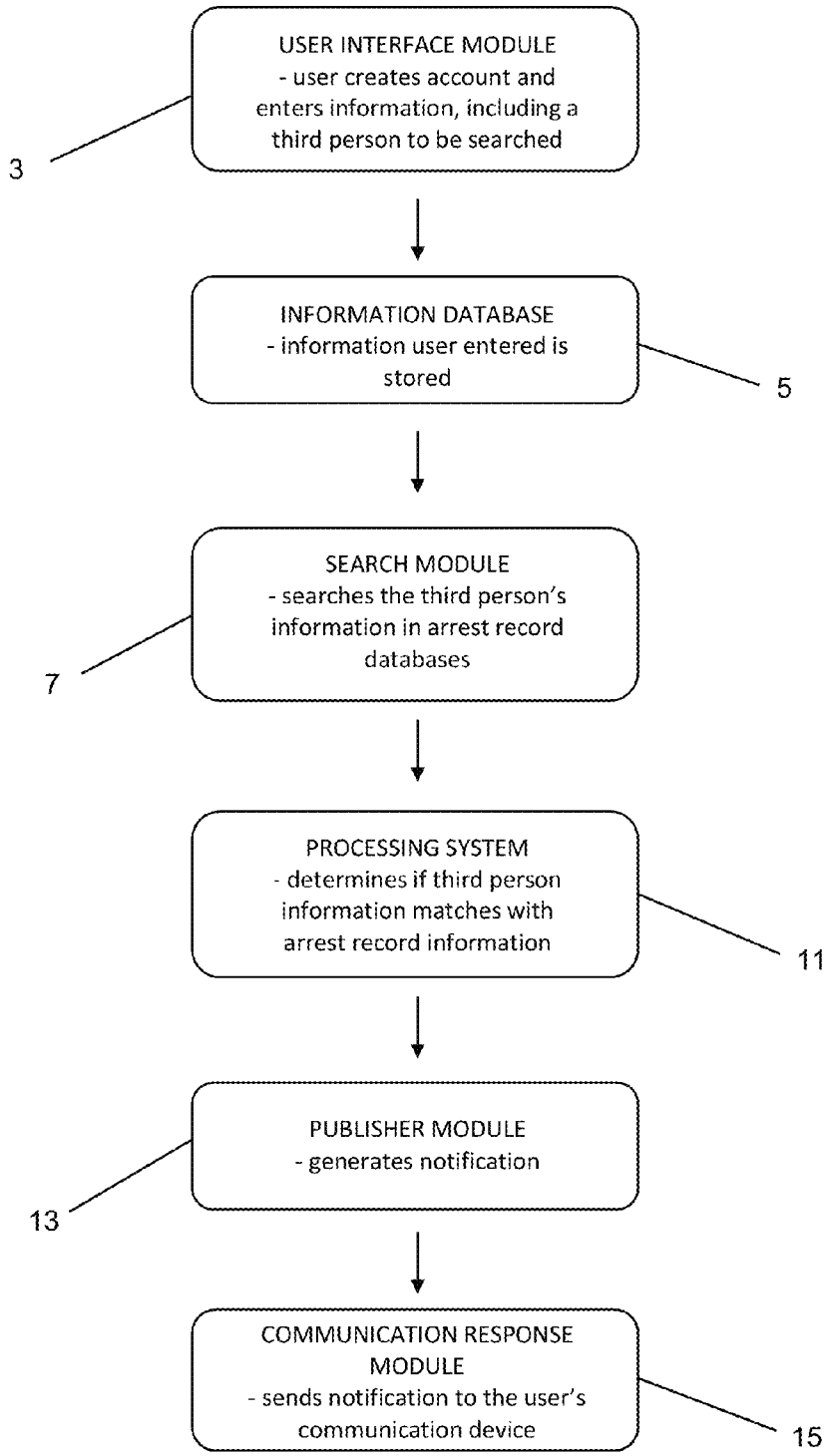
FIG. 3 is a schematic illustration of the system of the present invention.

Referring to FIG. 3, in another embodiment, if the user 1 would like the service to search a third party and be notified when that third party is arrested or incarcerated, then the user 1 may sign up for the service and input a third party's information into the user interface module's 3 plurality of data fields, such as name, height, weight, date of birth, hair color, eye color, etc. that is to be searched and then designate themselves, the user 1, as the designated contact 15. The user 1 will provide their preferred form of contact, which may be via text, e-mail, or another messaging service, and the user's 1 contact information will be stored in an information database 5 as a designated contact 15. A search module 7 is configured to search the public arrest databases for the third party's information that the user 1 entered. When the processing system 9 cross references and matches the third party's information with another name in an arrest record then the publisher module 11 will generate an automatic notification and the communication response module 13 will send the notification to the user 1 via the user's 1 stated notification preference. The notification may include, but is not limited to, the date, time, and location where the individual is being held.

In another embodiment, if one of the designated contacts 15 wishes, they may choose an option to receive a notification in the form of an automated voice message if the user 1 or a user's 1 third party is incarcerated. The user 1 either provides their own contact information, or provides the contact information of a designated third party, as a designated contact 15. If the processing system 9 matches a searched individual with the information in a public database, then the publisher module 11 will generate an automated voice message and call the requisite contact 17 and communicate the message to the answering party.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might ht further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims filed herewith are incorporated by reference in their entirety into the specification as if fully set forth herein.

I claim:

1. An automatic messaging system for providing notifications to a user's designated contact when the user has been arrested and is being held in police custody, said system comprising:

a server for receiving and storing user information data and designated contact information data before the arrest of the user occurs, said user information including the user's name and date of birth, and said designated contact information data including the name of the user's designated contact, the designated contact's phone number, and the designated contact's email address;

a search module for searching a public arrest database that includes public police arrest records of the user's arrest, said public arrest records including the name and date of birth of the user;

a processing system for determining a match between the name and date of birth of the user within the user information data and the name and date of birth of the user in the public arrest database search results;

a publisher module for generating a notification for the designated contact;

a communication response module for sending a message to the designated contact based on the designated contact information data; and, a communication device of the designated contact for receiving a notification.

2. The system of claim 1 wherein the notification is a text message.

3. The system of claim 1 wherein the notification is an e-mail.

4. The system of claim 1 wherein the notification is an automated voice message.

5. The system of claim 1 wherein the means of receiving user information data occurs over the internet.

6. The system of claim 1 wherein the means of receiving user information is by a tangible document.

7. The system of claim 1 wherein the database is a public arrest records database.

8. A method for automatically notifying a contact of an arrested user comprising:

receiving from the user, before the arrest occurs, information contained in at least one input in at least one data field, wherein said information includes the user's name and date of birth and the phone number and email of the contact;

storing at least the user's input information;

searching at least one public arrest database, wherein the public arrest database includes information regarding the arrest, including the name and date of birth of the user;

matching the name and date of birth from the user's input information to the name and date of birth of the user in the public arrest database;

generating at least one notification; and, sending at least one message to at least one contact regarding the arrest of the user.

9. The method of claim 8 wherein the notification is a text message.

10. The method of claim 8 wherein the notification is an e-mail.

11. The method of claim 8 wherein the notification is an automated voice message.

12. The method of claim 8 wherein the information is received via a website.

13. The method of claim 8 wherein the information is received via a tangible document.

* * * * *